US006817860B2

(12) United States Patent
Whittenberger

(10) Patent No.: US 6,817,860 B2
(45) Date of Patent: Nov. 16, 2004

(54) CATALYTIC COMBUSTOR WITH IMPROVED LIGHT-OFF CHARACTERISTICS

(75) Inventor: William A. Whittenberger, Leavittsburg, OH (US)

(73) Assignee: Catacel Corp., Leavittsburg, OH (US)

( * ) Notice: Subject to any disclaimer, the term of this patent is extended or adjusted under 35 U.S.C. 154(b) by 159 days.

(21) Appl. No.: 10/098,693

(22) Filed: Mar. 15, 2002

(65) Prior Publication Data

US 2003/0175633 A1 Sep. 18, 2003

(51) Int. Cl.[7] ..... F23D 21/00; F23Q 11/00
(52) U.S. Cl. ..... 431/170; 431/328; 431/268
(58) Field of Search ..... 431/7, 170, 328, 431/326, 268; 60/723; 502/339

(56) References Cited

U.S. PATENT DOCUMENTS 4,254,621 A * 3/1981 Nagumo ..... 60/282
4,576,800 A 3/1986 Retallick
5,202,303 A 4/1993 Retallick et al.
5,232,357 A * 8/1993 Dalla Betta et al. ..... 431/7
5,246,672 A * 9/1993 Bak ..... 422/174
5,512,250 A * 4/1996 Betta et al. ..... 422/173
5,577,906 A * 11/1996 Hanakata et al. ..... 431/268
6,060,173 A 5/2000 Retallick
6,284,323 B1 9/2001 Maloney
6,306,515 B1 10/2001 Goedjen et al.
6,334,769 B1 * 1/2002 Retallick et al. ..... 431/7
6,340,500 B1 1/2002 Spitsberg

FOREIGN PATENT DOCUMENTS

EP 0 724 069 A2 * 7/1996

OTHER PUBLICATIONS

Turbine Resources Unlimited, Inc. "Expert Coating Capabilities".
"Thermal Barrier Coatings: What are they and how are they used?" Hermanek, Praxair Surface Technologies, Aug. 12, 1999.

* cited by examiner

*Primary Examiner*—Josiah Cocks
(74) *Attorney, Agent, or Firm*—William H. Eilberg

(57) ABSTRACT

A catalytic combustor includes a plurality of channels formed by corrugated and flat strips, some of the channels being coated with a catalyst and others being uncoated. In the vicinity of the inlet end of the combustor, the boundary of each coated channel has a thermal barrier, to inhibit the flow of heat from the coated channel to an adjacent uncoated channel. Also in the vicinity of the inlet end, the coated channels may include one or more additional coated members, to enhance catalytic combustion in the light-off zone. The combustor of the present invention lights off at a relatively low temperature, and quickly reaches a stabilized and controlled operating temperature.

10 Claims, 5 Drawing Sheets

CATALYTIC COMBUSTOR WITH IMPROVED LIGHT-OFF CHARACTERISTICS

BACKGROUND OF THE INVENTION

This invention relates to catalytic combustors, especially those made of a stack of alternating corrugated and flat pieces of metal foil, defining a plurality of channels for gas flow.

It has been known to make catalytic combustors by providing one or more strips of metal foil, stacking and/or folding the strips to form a monolith, and coating all or part of the monolith with catalyst. Examples of such combustors are given in U.S. Pat. Nos. 4,576,800, 5,202,303, and 6,060,173, the disclosures of which are incorporated herein by reference.

Catalytic combustors typically include flat strips alternating with corrugated strips. The corrugations hold the flat strips apart, and thereby prevent the monolith from collapsing. The corrugations also serve to define a cross-section having a large number of channels or cells.

As described, for example, in U.S. Pat. No. 5,202,303, it is advantageous to provide a catalyst coating on fewer than all of the channels of the combustor. The coated channels can be designated "hot" and the uncoated channels can be designated "cold". The use of cold channels, interspersed with hot channels, prevents "runaway" combustion wherein the temperature of the combustor could become great enough to destroy the catalyst.

One disadvantage of the combustor described above lies in the difficulty of starting combustion. The process of initiating combustion is known as "light-off". Approximately the first inch of the inlet end of the combustor is known as the light-off zone, because it is there that the combustion begins. In a combustor in which coated and uncoated channels alternate with each other throughout the combustor, the inlet temperatures must be unreasonably high to achieve light-off.

One improvement which addresses the above problem is described in U.S. patent application Ser. No. 09/586,482, filed Jun. 1, 2000, entitled "Catalytic Combustor Having Reduced Light-Off Temperature", the disclosure of which is incorporated by reference herein. In the combustor disclosed in the cited application, there is a band of catalyst coating, provided along a portion of the inlet end of the combustor, on a side of the strip which would otherwise be free of catalyst coating. This extra coated band works well to facilitate light-off because, at the inlet end of the combustor, all of the channels are hot rather than cold.

However, the above approach has some disadvantages. Since there is now some combustion in the channels intended for cooling, the overall catalyzed combustion for the system must be more than 50%, assuming a design in which half the channels are coated and half are uncoated. Moreover, the amount of combustion in the cooling channel is somewhat unpredictable, because the reaction is governed by both kinetics and mass transfer. Modeling and experiments have shown that minor changes in inlet temperature can lead to wild excursions in outlet temperature.

The ideal catalytic combustor is one in which 1) light-off occurs at a relatively low temperature, 2) the increase in outlet temperature occurs very rapidly after light-off, and 3) the outlet temperature quickly stabilizes, at a final operating temperature, shortly after light-off. The present invention provides a combustor which achieves all of these goals.

SUMMARY OF THE INVENTION

The present invention comprises a catalytic combustor formed of a plurality of corrugated strips alternating with a plurality of flat strips. The corrugated and flat strips together define a plurality of channels, some of the channels being coated with catalyst and some of the channels being uncoated. The combustor is modified, at the inlet end only, in one or both of the following two ways. First, there may be a thermal barrier, located along the boundary of at least one of the coated channels, for inhibiting the flow of heat from the coated channel to an adjacent uncoated channel. Secondly, there may be an additional coated strip, located within at least one of the coated channels, for enhancing the catalytic combustion that occurs in the coated channel, thereby improving the light-off performance of the combustor.

The above-described modifications, namely the thermal barrier and the additional coated strip, may be present separately or in combination. Also, there may be two or more additional coated strips, disposed within one of more of the coated channels.

The thermal barrier may be an insulating layer, disposed on the boundary of the coated channel, the insulating layer being located between the wall of the channel and the catalyst. The barrier could also be a separate strip or fabric, or other member capable of providing thermal insulation and of holding a catalyst. The thermal barrier may also include an air gap between the member that holds the catalyst and the wall of the channel. The preferred thermal barrier is a thermally insulating coating that is sprayed onto the wall of the channel, such that the catalyst can be added to the insulating coating. The latter technique avoids the need for registration of a strip or fabric with the primary corrugated strip.

The present invention therefore has the primary object of providing a catalytic combustor.

The invention has the further object of improving the light-off characteristics of a catalytic combustor.

The invention has the further object of reducing the temperature of light-off, reducing the time to achieve a stabilized operating temperature, and limiting the final operating temperature, in a catalytic combustor.

The invention has the further object of providing a catalytic combustor which lights off quickly, but in which the operating temperature is controlled so as not to harm the catalyst.

The reader skilled in the art will recognize other objects and advantages of the present invention, from a reading of the following brief description of the drawings, the detailed description of the invention, and the appended claims.

DETAILED DESCRIPTION OF THE INVENTION

Figure 2:
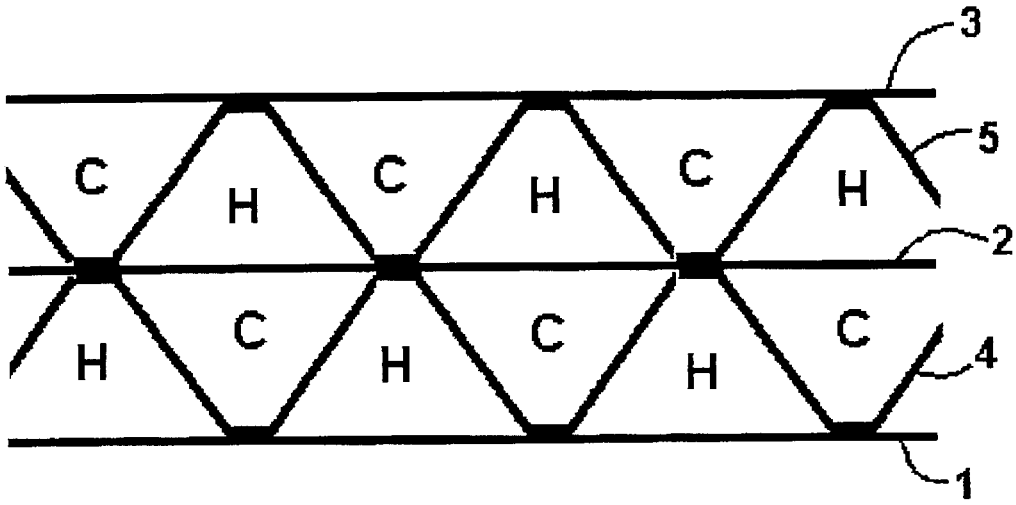
FIG. 2 provides a cross-sectional view of the catalytic combustor of the present invention, taken in a position other than in the light-off zone.

FIG. 2 provides a cross-sectional view of a catalytic combustor of the present invention, taken at a position other than at the inlet end. The structure shown in FIG. 2 is similar to that of prior art combustors, except that the prior art combustors have the same structure throughout, including the inlet end.

The combustor of FIG. 2 includes flat metal strips 1, 2, 3 which alternate with corrugated strips 4 and 5. In this specification, the corrugated strips 4 and 5 are sometimes designated "primary" corrugated strips, to distinguish them from additional corrugated strips, to be described later. The primary corrugated strips are so called because they define the basic structure of the combustor.

The strips shown in FIG. 2 define a plurality of channels for gas flow. In the view shown, the gas flows in a direction perpendicular to the paper. The walls of some of the channels are coated with catalyst, and the walls of other channels are uncoated. In this specification, a channel whose walls are coated with catalyst is designated in the drawings by the letter "H", indicating a "hot" channel, and a channel whose walls are not coated is designated by the letter "C" for "cold". All of the strips are coated on one side only.

As mentioned above, if the entire combustor is defined by FIG. 2, including the portion at the inlet end, the combustor is the same as combustors of the prior art. Such a prior art combustor would have the light-off characteristics represented by one of the curves in FIG. 1, as described below.

Figure 1:
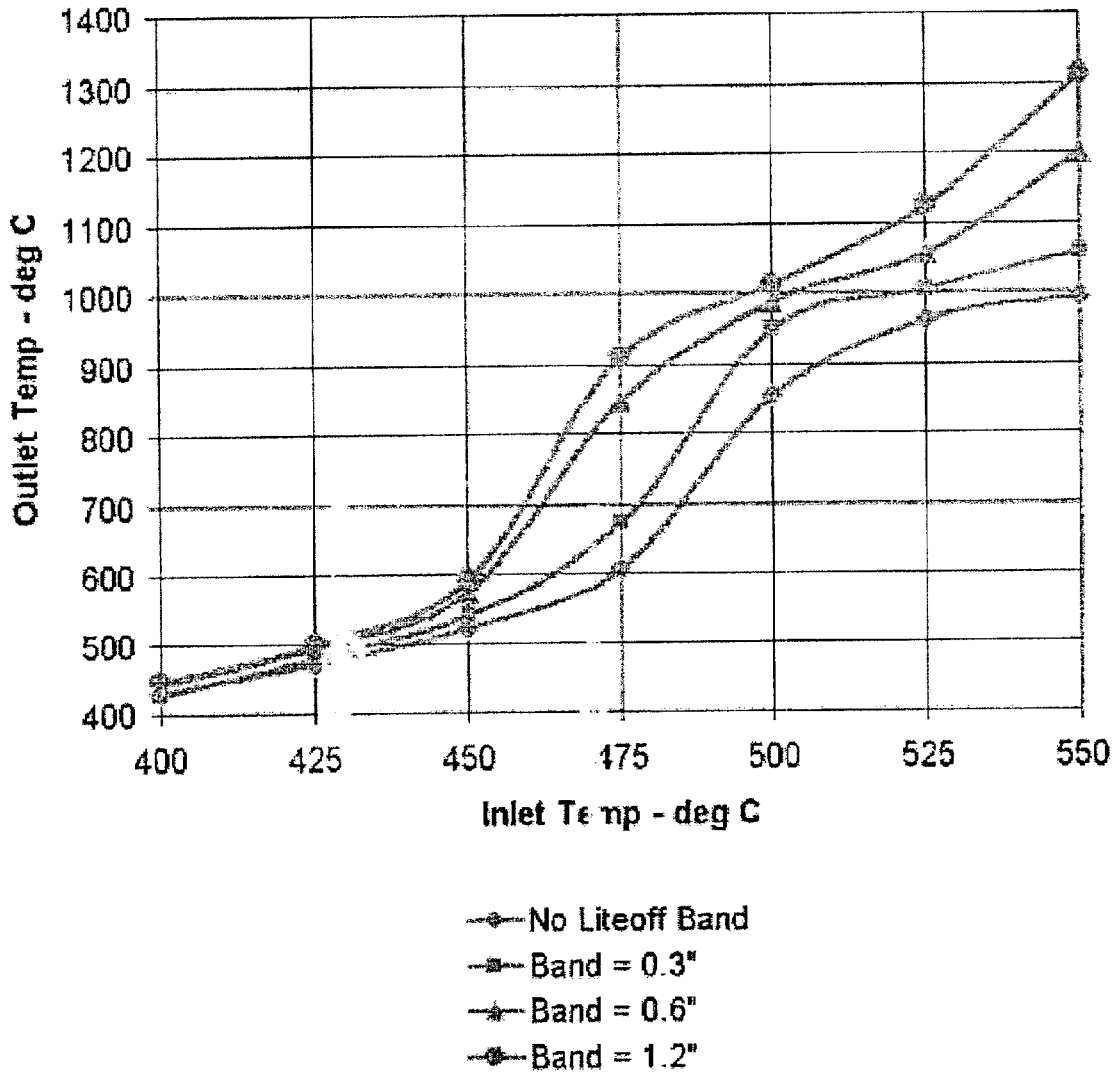
Figure 1 Prior Art
FIG. 1 provides a graph describing the performance of various catalytic combustors made according to the prior art.

FIG. 1 provides a graph showing the performance of four prior art combustors. The points represented by diamonds refer to a combustor which has the structure of FIG. 2 throughout, i.e. a combustor in which hot and cold channels are equally distributed through the monolith, and in which the cold channels all extend along the entire length of the combustor. The points represented by the squares, triangles, and circles refer to structures in which the cold channels have a band of catalyst at the inlet end, as described above. These points pertain to coated bands having lengths (as measured in the direction of gas flow) of 0.3, 0.6, and 1.2 inches, respectively.

FIG. 1 is derived in part from actual measurement, and in part from extrapolation and modeling. Actual measurements were taken, for inlet temperatures from 400° F. to 475° F., for the cases of no coated band and a band of length 1.2 inches. A simple finite difference model using mass transfer and kinetic theory was constructed to describe these reactors. Kinetic constants were adjusted in the model so that the outlet temperatures agreed with the measurements taken. Then, the model was used to provide predicted outlet temperatures corresponding to inlet temperatures of up to 550° F. The model was also used to generate the complete curves pertaining to the bands of length 0.3 and 0.6 inches.

FIG. 1 shows that when there is no light-off band, the outlet temperature rises very slowly, with an increase in inlet temperature, indicating a difficult light-off process. The curves representing the combustor having light-off bands at the inlet ends of the cold channels, show a more rapid light-off process, but they also show an ever-increasing outlet temperature, indicating uncontrolled combustion. Thus, none of the prior art combustors represented in FIG. 1 satisfies all three of the above-stated goals.

The present invention comprises a combustor in which the hot channels have been modified, but only in the vicinity of the light-off zone.

Figure 3:
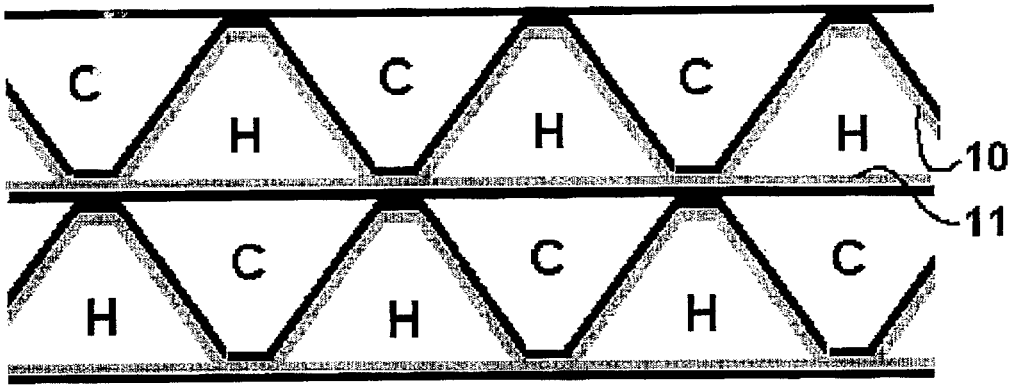
FIG. 3 provides a cross-sectional view of one embodiment of the combustor of the present invention, taken in the light-off zone, showing an insulating layer located on the boundary of each hot channel.

One way to modify the hot channels is to add an insulating layer to the boundary of the channel. This concept is illustrated in FIG. 3, which shows insulating layer 10 located on the hot side of each of the primary corrugated strips, and another insulating layer 11 located on the hot side of each of the flat strips. The term "hot side" means the side of the strip which forms a wall or boundary for a hot channel. As shown in FIG. 3, each hot channel in the light-off zone has an insulating layer along its boundary. The purpose of the insulating layers is to reduce the amount of heat transfer from the hot channels to the cold channels, in the light-off zone.

The insulating layers can comprise a thermal barrier coating, placed on the corrugated strip, under the catalyst coating. Such thermal barrier coatings are well-known in the art pertaining to the operation of gas turbines. Examples of such thermal barrier coatings are given in U.S. Pat. Nos. 6,284,323, 6,306,515, and 6,340,500, the disclosures of which are hereby incorporated by reference herein.

Thermal barrier coatings are also commercially available from Praxair, Inc., Indianapolis, Ind., and from Turbine Resources Unlimited, Inc., of West Winfield, N.Y. (www.calltru.com).

For simplicity of illustration, the catalyst coating is not explicitly shown, though the presence of a coating in any given channel is implied by the symbol "H".

Alternatively, the insulating layer can be one or more additional corrugated or flat strips, arranged to mate with the primary corrugated or flat strips, as appropriate. That is, the additional strips can mate with any of strips 1, 2, 3, 4, and 5. In this case, the strips comprising the insulating layer are coated on one side with catalyst, the coating being present on the side which now defines the boundary of the hot channel.

In still another alternative, the insulating layer can be a fabric or ceramic blanket. Again, it is necessary that the side of the fabric or blanket which defines the boundary of the hot channel be coated with catalyst.

In still another alternative, the insulating layer can be an insulating coating applied directly to the primary corrugated strip, and/or to the flat strip, on the side defining the wall of the hot channel. The insulating coating is impregnated with catalyst, to define the desired hot channel.

In another alternative, the thermal barrier also includes an air gap between the insulating layer and the primary corrugated strip and/or flat strip, to provide additional thermal insulation.

In cases where the insulating layer 10 or 11 comprises a separate strip or fabric, it is not necessary to coat the primary corrugated or flat strip with catalyst, in the light-off zone, because that portion of the primary corrugated strip will be covered by the insulating layer. However, the manufacturing process may be simplified by providing the catalyst coating on the entire strip anyway, even though the portion of that coating in the light-off zone will have no effect.

Thermal barrier coatings may be used on the primary corrugated strip, as well as on one or both sides of the strip used as insulating layer 10.

The thermal barrier coatings mentioned above may be thermally or plasma-sprayed exotic mixtures of oxides, such as those used in the gas turbine industry. They may also be as simple as the alumina or zirconia washcoats that are commonly used to hold the catalyst, but without the catalyst metals themselves. They may also include hexaluminates.

Although the invention includes all of the above alternatives for providing the insulating layer, the preferred arrangement is that in which the insulating layer is applied directly to the primary corrugated and flat strips. Thus, in the most preferred embodiment, an insulating layer is sprayed onto the primary corrugated and flat strips, in the light-off zone, and the insulated portions of the strips are then coated with catalyst. This method eliminates the need to align another corrugated strip, or a fabric or blanket, with the primary corrugated strip.

Figure 4:
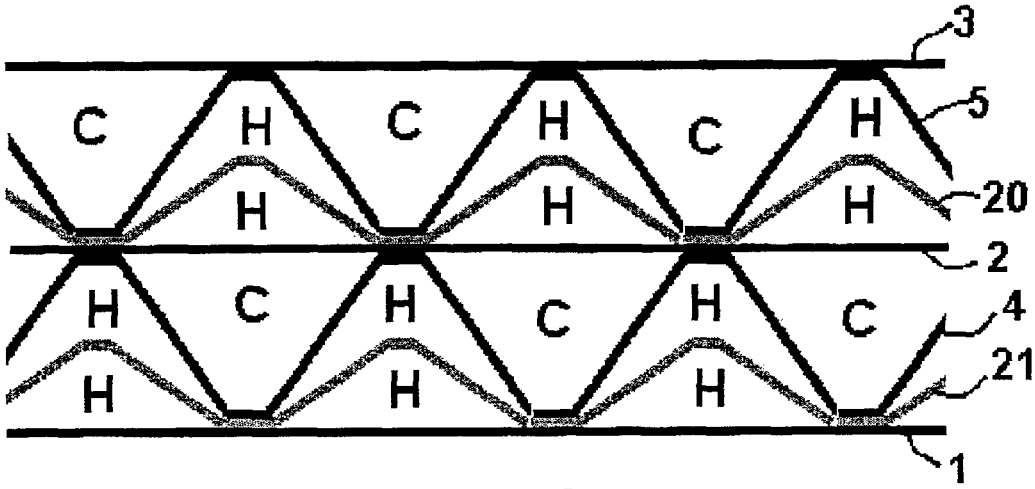
FIG. 4 provides a cross-sectional view of another embodiment of the combustor of the present invention, taken in the light-off zone, and showing an additional coated strip located within each hot channel.

In another embodiment of the invention, shown in FIG. 4, the combustor includes an additional corrugated strip 20, coated on both sides with catalyst, and present only in the light-off zone. The strip 20 has corrugations which are in phase with the corrugations of primary corrugated strip 5. The corrugations of strip 20 have an amplitude less than that of the corrugations of the primary corrugated strip. The features hold true for additional corrugated strip 21, relative to primary corrugated strip 4. The result is that the additional corrugated strips divide each hot channel into a plurality of hot channels, as shown in the drawing. Also, the additional strips do not occupy the cold channels at all. The additional strips 20 and 21 comprise catalyst supports to provide additional catalyst within the hot channel, and these strips thereby increase the mass transfer in the light-off zone, and further promote light-off.

Figure 5:
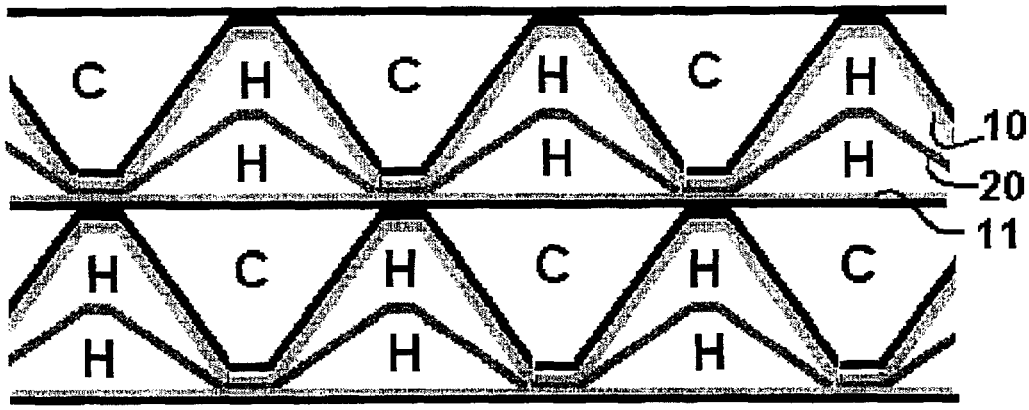
FIG. 5 provides a cross-sectional view of another embodiment of the present invention, taken in the light-off zone, wherein the features shown in FIGS. 3 and 4 are combined in the same combustor.

Another embodiment of the invention, shown in FIG. 5, combines the features of FIGS. 3 and 4. That is, the combustor of FIG. 5 has, in the light-off zone, both insulating layers 10 and 11, made according to any of the constructions described above, and an additional coated corrugated strip 20.

Figure 6:
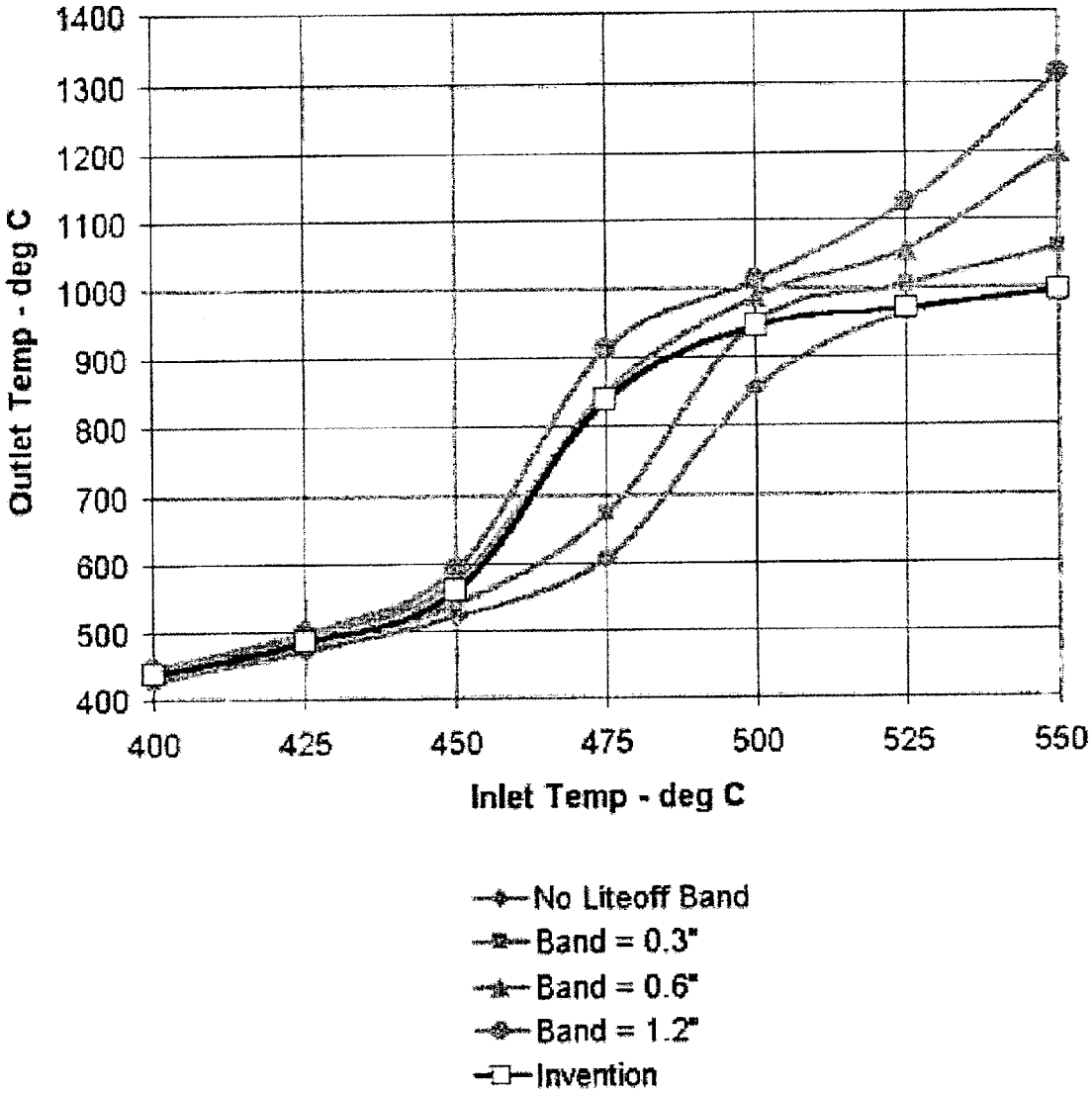
FIG. 6 provides a graph illustrating the expected performance of the combustor shown in FIG. 5.

FIG. 6 shows the predicted performance of the present invention, as compared with combustors of the prior art. The prior art data points are the same as those of FIG. 1. The data for the present invention, indicated by hollow squares, pertain to a combustor having a light-off zone that is 0.6 inches long, and having the general structure of FIG. 5, in the light-off zone. The insulation was chosen so as to block 90% of the heat transfer. The same model used for FIG. 1 was used to generate the data for FIG. 5. Note that the light-off performance of this combustor is similar to that of the prior art combustors having light-off bands, but that the maximum outlet temperature is limited, and is similar to that of the prior art combustor in which the strips are coated on one side only. Thus, the combustor of the present invention satisfies all three goals stated above.

Figure 7:
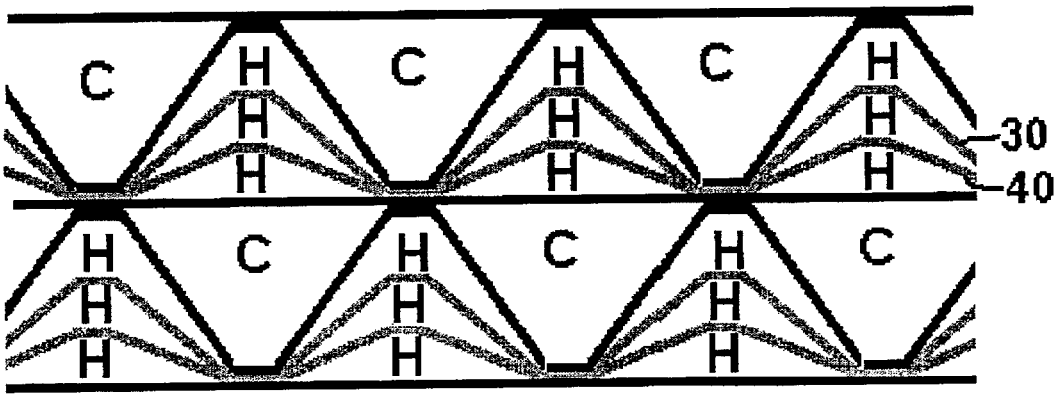
FIG. 7 provides a cross-sectional view of another embodiment of the combustor of the present invention, taken in the light-off zone, wherein there are two additional coated strips in each hot channel.

Another embodiment of the present invention includes two additional coated corrugated strips, as shown in FIG. 7. In FIG. 7, additional coated corrugated strips 30 and 40 are provided in the light-off zone, with a gap between them. This arrangement creates an extremely isolated area between the strips 30 and 40 where combustion can take place with very little cooling. The embodiment of FIG. 7 results in a larger number of small hot channels, as represented by the symbols "H".

Figure 8:
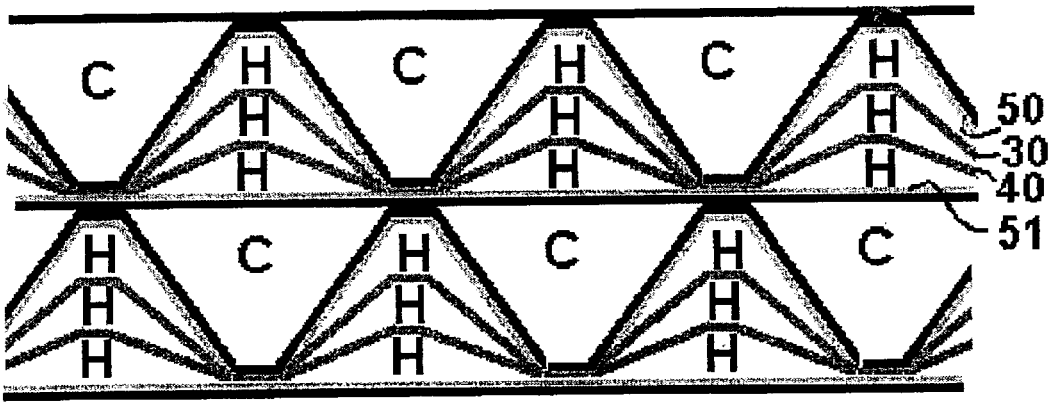
FIG. 8 provides a cross-sectional view of another embodiment of the present invention, taken in the light-off zone, wherein there are two additional coated strips in each hot channel, and wherein there is an insulating layer located on the boundary of each hot channel.

The embodiment of FIG. 7 can be combined with that of FIG. 3, as shown in FIG. 8. In FIG. 8, there are insulating layers 50 and 51, similar to those of FIG. 3, in addition to the strips of FIG. 7. This embodiment provides still more thermal insulation between the hot and cold channels.

The invention can be modified in other ways. Further additional coated corrugated strips could be added. The nature of the insulating layer, if used, can be modified. These and other modifications, which will be apparent to those skilled in the art, should be considered within the spirit and scope of the following claims.

What is claimed is:

1. A catalytic combustor comprising a plurality of primary corrugated strips alternating with a plurality of flat strips, wherein the primary corrugated and flat strips define a plurality of channels, wherein some of the channels are coated with catalyst and wherein some of the channels are not coated with catalyst, wherein the combustor has an inlet end and an outlet end, and wherein the combustor further comprises, in a vicinity of the inlet end, an additional coated corrugated strip having corrugations in phase with, and of lesser amplitude than, corrugations of the primary corrugated strip, wherein the additional strip divides each coated channel into more than one coated channel.

2. The catalytic combustor of claim 1, wherein each coated channel includes, in a vicinity of the inlet end, at least two additional coated corrugated strips.

3. The catalytic combustor of claim 1, wherein at least some of the coated channels have, in a vicinity of the inlet end, a thermal barrier disposed between a strip defining the channel and the catalyst coating.

4. The catalytic combustor of claim 2, wherein at least some of the coated channels have, in a vicinity of the inlet end, a thermal barrier disposed between a strip defining the channel and the catalyst coating.

5. A catalytic combustor comprising a plurality of primary corrugated strips alternating with a plurality of flat strips, wherein the primary corrugated and flat strips define a plurality of channels, wherein some of the channels are coated with catalyst and wherein some of the channels are not coated with catalyst, and wherein a portion of some of the coated channels also include means for inhibiting heat transfer from a coated channel to an uncoated channel, the combustor further comprising an additional strip, coated with catalyst, and located within one of said coated channels, the additional strip having corrugations in phase with, and of lesser amplitude than, corrugations of a primary corrugated strip.

6. The catalytic combustor of claim 5, wherein the additional strip has two sides, and wherein the additional strip is coated with catalyst on both of said two sides.

7. A catalytic combustor comprising a plurality of corrugated strips alternating with a plurality of flat strips, wherein the corrugated and flat strips define a plurality of channels, wherein some of the channels are coated with catalyst and wherein some of the channels are not coated with catalyst, and wherein a portion of some of the coated channels also include means for inhibiting heat transfer from a coated channel to an uncoated channel, wherein the heat transfer inhibiting means comprises a thermal barrier located on at least a portion of a strip defining one of said coated channels, further comprising an additional strip, coated with catalyst, and located within one of said coated channels, wherein the additional strip has two sides, and wherein the additional strip is coated with catalyst on both of said two sides.

8. A catalytic combustor comprising a plurality of primary corrugated strips alternating with a plurality of flat strips, wherein the primary corrugated and flat strips define a plurality of channels, wherein some of the channels are coated with catalyst and wherein some of the channels are not coated with catalyst, wherein the combustor has an inlet end and an outlet end, and wherein at least some of the coated channels have, in a vicinity of the inlet end, a thermal barrier disposed between a strip defining the channel and the catalyst coating, wherein the combustor further comprises, in a vicinity of the inlet end, an additional coated corrugated strip having corrugations in phase with, and of lesser amplitude than, corrugations of the primary corrugated strip, wherein the additional strip divides each coated channel into more than one coated channel, wherein the additional strip has two sides, and wherein the additional strip is coated with catalyst on both of said two sides.

9. A catalytic combustor comprising a plurality of primary corrugated strips alternating with a plurality of flat strips, wherein the primary corrugated and flat strips define a plurality of channels, wherein some of the channels are coated with catalyst and wherein some of the channels are not coated with catalyst, wherein the combustor has an inlet end and an outlet end, and wherein the combustor further comprises, in a vicinity of the inlet end, an additional coated corrugated strip having corrugations in phase with, and of lesser amplitude than, corrugations of the primary corrugated strip, wherein the additional strip divides each coated channel into more than one coated channel, wherein the additional strip has two sides, and wherein the additional strip is coated with catalyst on both of said two sides.

10. A catalytic combustor comprising a plurality of corrugated strips alternating with a plurality of flat strips, wherein the corrugated and flat strips define a plurality of channels, wherein the combustor has an inlet end and an outlet end, wherein some of the channels are coated with catalyst and wherein some of the channels are not coated with catalyst, wherein a portion of some of the coated channels include, only in a vicinity of the inlet end, a thermal barrier which inhibits heat transfer from a coated channel to an uncoated channel, and wherein the combustor further comprises an additional strip, coated with catalyst, and located within one of said coated channels, in a vicinity of the inlet end, wherein the additional strip has two sides, and wherein the additional strip is coated with catalyst on both of said two sides.

* * * * *